US006712065B2

(12) United States Patent
Rummel et al.

(10) Patent No.: US 6,712,065 B2
(45) Date of Patent: Mar. 30, 2004

(54) GAS COOKTOP

(75) Inventors: Randy L. Rummel, Florence (IT); Dan Nichols, Huntington Beach, CA (US); Eric H. Y. Deng, Irvine, CA (US)

(73) Assignee: Dynamic Cooking Systems, Inc., Huntington Beach, CA (US)

( * ) Notice: Subject to any disclaimer, the term of this patent is extended or adjusted under 35 U.S.C. 154(b) by 213 days.

(21) Appl. No.: 09/960,041

(22) Filed: Sep. 20, 2001

(65) Prior Publication Data

US 2003/0051724 A1 Mar. 20, 2003

(51) Int. Cl.[7] ..... F24C 15/10
(52) U.S. Cl. ..... 126/211; 126/212; 126/214 C
(58) Field of Search ..... 126/211, 212, 126/214 C, 39 R, 152 R, 153 B; D7/346, 341, 408, 409, 407

(56) References Cited

U.S. PATENT DOCUMENTS 2,654,359 A * 10/1953 Reeves ..... 126/39 K
2,766,683 A * 10/1956 Kanz ..... 99/425
2,823,657 A * 2/1958 Brodbeck ..... 126/37 A
2,973,524 A 3/1961 Daniels
D201,938 S 8/1965 Tecton
4,971,024 A 11/1990 Albon et al.
D378,262 S * 3/1997 Sparks
6,257,228 B1 * 7/2001 Braccini ..... 126/211
D461,090 S * 8/2002 Rummel
D467,461 S * 12/2002 Jones
D473,096 S * 4/2003 Resuello

FOREIGN PATENT DOCUMENTS

FR 2614677 A3 11/1988

* cited by examiner

*Primary Examiner*—Alfred Basichas
(74) *Attorney, Agent, or Firm*—Knobbe, Martens, Olson & Bear LLP

(57) ABSTRACT

Five burners are arranged in the form of an "x." The units are covered by a grate including two side sections, each covering two burners, and a central section covering the center burner. The side sections have concave inner side edges that mate with a circular segment of the center grate.

6 Claims, 3 Drawing Sheets

GAS COOKTOP

BACKGROUND OF THE INVENTION

This invention relates to the construction of a gas cooktop or range in a particularly efficient and compact arrangement.

In smaller kitchens, space for a gas cooktop is limited. One common width for smaller residential ranges is 30 inches, with the cooktop having four burners arranged in the form of a rectangle.

In some busy cooking situations, it is desirable to have more than four burners. Further, in some situations, it is desirable to have a particularly large container positioned over a burner. With the compact four burner arrangement, a large container cannot be centrally positioned on any of the units without hanging over a side edge of the cooktop, and that space is typically not available for such positioning because of an adjacent counter, wall or other restriction. Further, even if space is available adjacent the sides of the cooktop, the back units could not be utilized because the container would engage the short back wall of the cooktop or the adjacent wall in the kitchen. If the front units were employed, the container might hang over the front edge of the cooktop and be in a somewhat precarious or dangerous position.

Cooktops are of course available having more than four burners, but the burners are not arranged sufficiently compact to fit a 30" width requirement.

Accordingly, the need exists for an improved gas cooktop or range construction to satisfy the foregoing objectives.

SUMMARY OF THE INVENTION

Briefly stated, a gas cooktop or range is provided having five burners arranged in a very compact manner. Four burners are positioned in a rectangular pattern with a fifth burner centrally positioned between the four. More specifically, the fifth burner is positioned halfway between the two front to back rows and halfway between the two side to side rows. With such an arrangement, a cooktop can be provided with no more than a 30 inch width and an even smaller front to back dimension of about 24 inches. Of course, the five burner configuration is also practical and space efficient in situations in which each individual burner is to be made larger, or spaced further from adjacent units.

With gas burners, it is of course necessary to have a grate above the burners. In a preferred gas cooktop arrangement, the grate is formed in three sections. This includes two spaced side sections extending from front to back with each side section extending over a front burner and a back burner. A central grate section extends from front to back and mates with the adjacent side sections. The side sections have a generally rectangular shape, except that the edge facing the central section has a concave central portion curved to fit with circular central section that extends over the central burner. The circular section is integral with relatively narrow front and back portions that extend respectively to be aligned with the front and back edges of the adjacent side sections.

DETAILED DESCRIPTION OF THE PREFERRED EMBODIMENT

Figure 1:
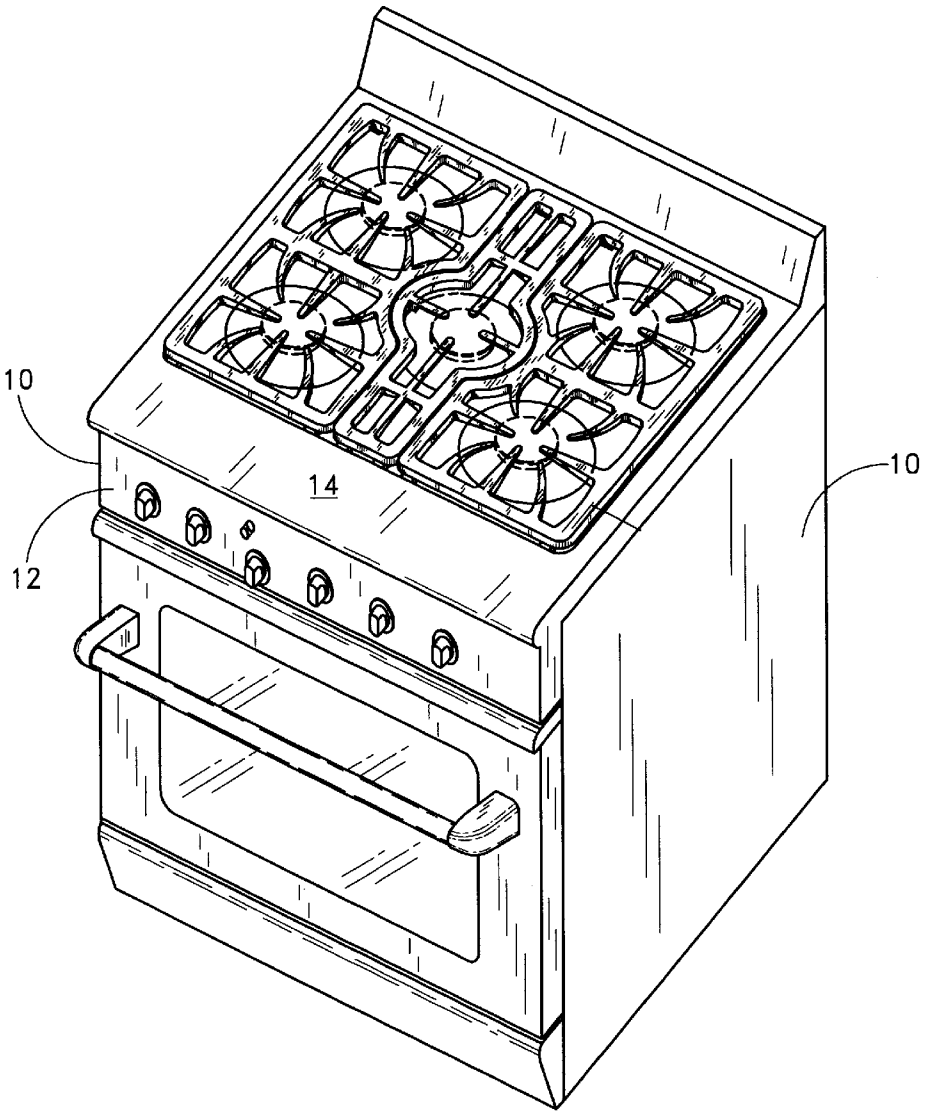
FIG. 1 is a perspective view of a range with a five burner cooktop.
Figure 2:
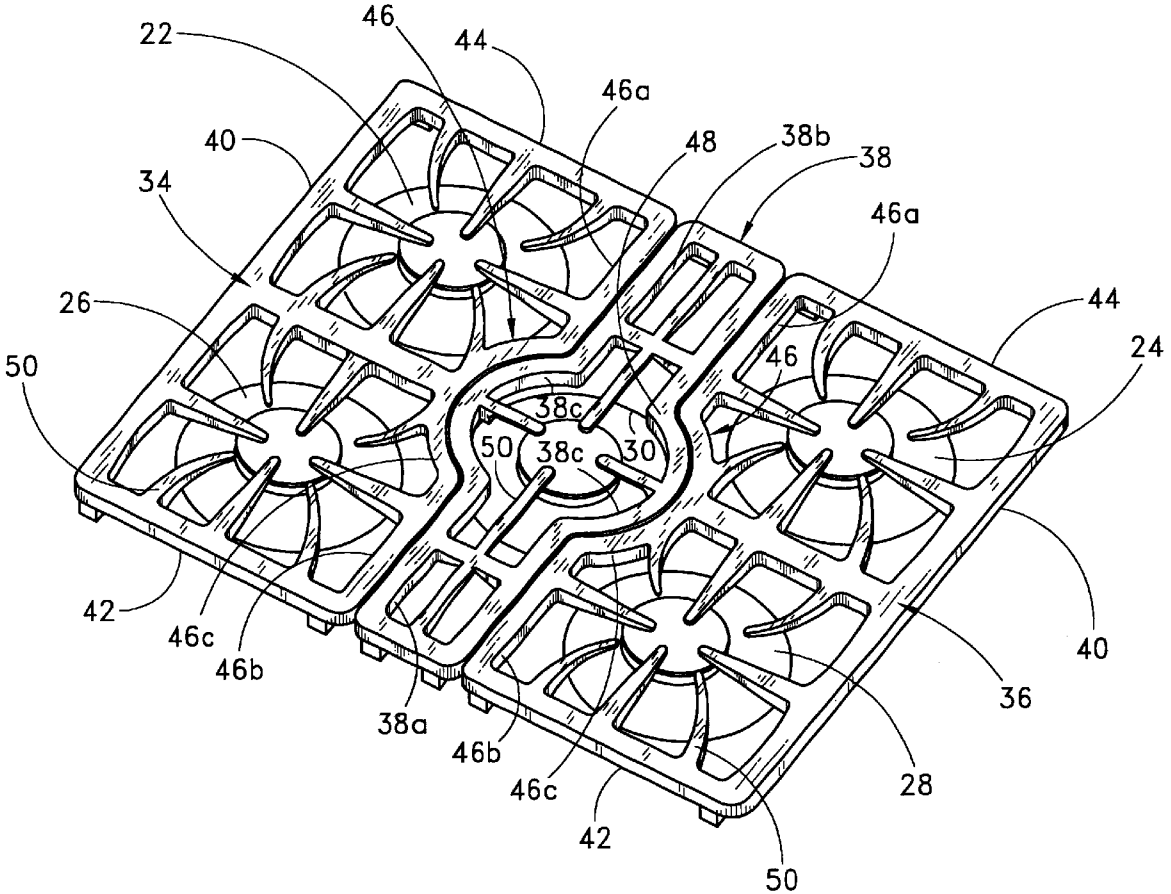
FIG. 2 is a perspective view of the cooktop of FIG. 1.
Figure 3:
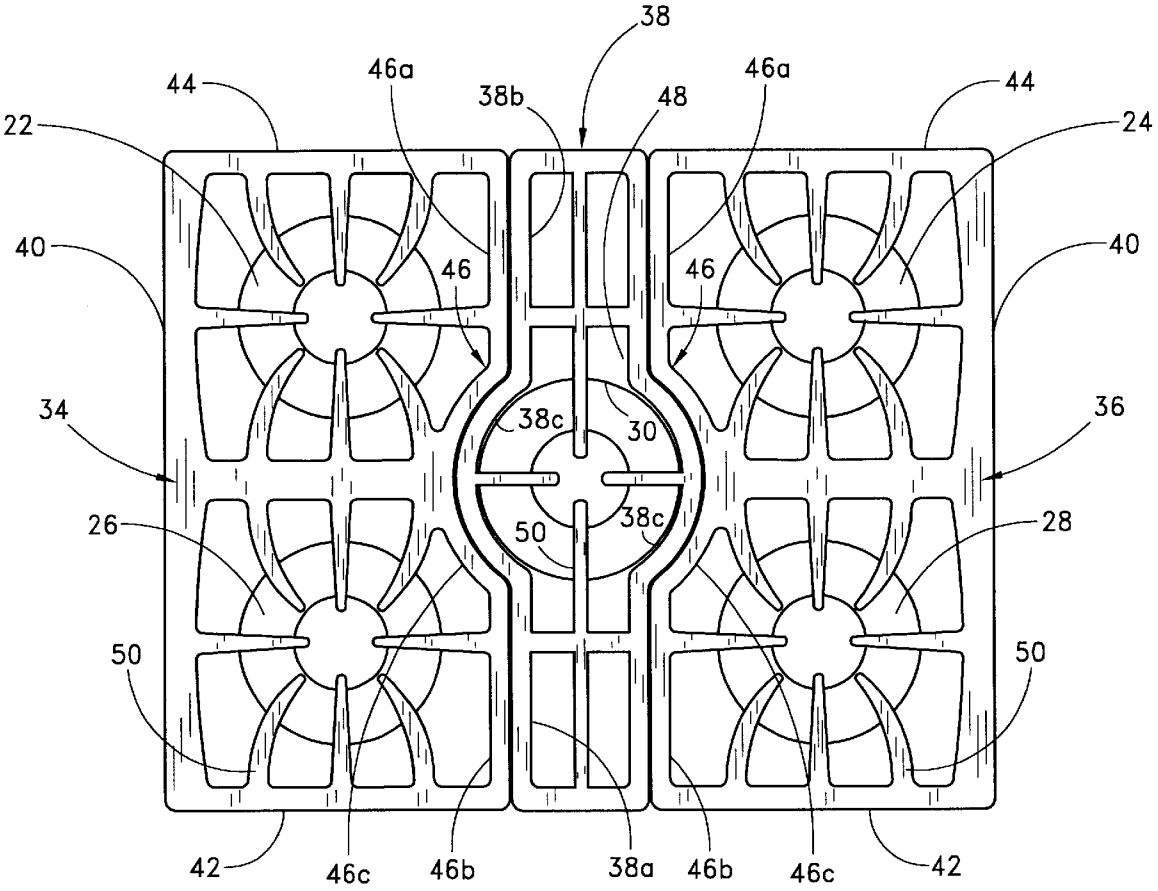
FIG. 3 is a plan view of the cooktop of FIG. 2.

Referring to the drawings, illustrated in FIG. 1 is a gas range 10 including an oven 12 and a cooktop 14. As can be seen, particularly from FIGS. 2 and 3, the cooktop has five circular burners. This includes four burners 22, 24, 26, and 28 arranged in a generally rectangular configuration with burners 22 and 24 forming a back row and burners 26 and 28 forming a front row. Stated differently, burners 22 and 24 form a left side, back-to-front row, and burners 24 and 28 form a right side, back-to-front row. While the cooktop is shown on a gas range, it can of course be simply a counter mounted cooktop.

In accordance with the invention, these four burners are preferably positioned so that a fifth burner 30 is centrally positioned between the other four. As can be seen, the fifth unit is centrally positioned between the two side rows and centrally positioned between the front and back rows. Stated differently yet, the burner 30 is centrally positioned between the front and back edges of the cooktop and spaced centrally between the left and right side edges of the cooktop. As another relationship, it can be stated that the center of the burner 30 is preferably at the intersection of a diagonal line between the centers of burners 22 and 28 and a diagonal line between the centers of burners 24 and 26, thus forming an "x."

With gas burners, a grate extends over the burners. In the arrangement illustrated, the grate includes a left grate section 34, a right grate section 36 and a central grate section 38. As may be seen, the left and right sections have generally a rectangular shape with an outer side wall 40, a front end wall 42, a rear end wall 44, and an inner side wall 46. Each side section extends over a front and rear burner. The outer side wall and the end walls of each side section are straight; however, the inner wall, which faces the fifth burner 30, has straight front and back portions 46*a* and 46*b* with a concave recess 46*c* between the straight portions. These recessed portions form circular segments surrounding a portion of the center burner 30. More specifically, each recessed portion 46*c* extends about 135° of a circle.

Between the side grate sections, the center section 38 has a generally circular portion 38*c* positioned above the central burner 30 and centered between the front and back edges of the cooktop. The side circular segments of the central grate form convex segments that conform to or mate with the recessed portions of the adjacent edges of the side grate sections. In addition, the central section has a front segment 38*a* extending to the front edge of the side sections and a rear segment 38*b* extending to the rear of the side sections. The width of the front and rear segments is about half the outer diameter of the central portion 48 of the central grate section 38. Each of the grate sections includes a plurality of inwardly extending spaced fingers 50 for supporting a cooking utensil over a respective burner. Having the grate sections configured as illustrated is practical from the standpoint that they are easy to handle, allowing individual sections to be separately removed and replaced. Likewise, the size is such that they are convenient from a manufacturing and handling standpoint. In addition, the arrangement is aesthetically pleasing.

The grill sections are all in substantially the same plane. Thus, when an extra large container is placed over the center burner 30, the container can extend over the area above the surrounding burners, maximizing the size of container to be used.

From the foregoing, it can be seen that the compact arrangement illustrated provides the fifth burner in a 30 inch width cooktop that conventionally only accommodated four burners. The side units have been spread slightly from that typically employed with four burners in a 30 inch wide cooktop. The fifth, burner 30 enables a large cooking utensil, such as a wok, to be centrally positioned on the central grate portion 48 without having to be concerned about a portion of the container extending over an edge of the cooktop.

The present invention may, of course, be carried out in other specific ways than those herein set forth without departing from the spirit and the central characteristics of the invention. For example, the particular dimensions used in describing the invention are not intended to limit the scope of the claims, but are provided only as examples. The present embodiments are therefore to be considered in all respects as illustrative and not restrictive and all changes, within the meaning and equivalency range of the appended claims, are intended to be embraced therein.

What is claimed is:

1. A gas cooktop comprising:

four gas burners arranged in substantially a rectangular shape;

a fifth gas burner centrally positioned between the four burners, with the fifth burner being substantially equal distant from each of the four burners; and a grate extending over said burners to define an upper plane for supporting cooking utensils and that enables a utensil above the fifth burner to overlap into area partially above any of the surrounding four burners; and wherein said grate includes two side sections, each extending over two of said burners, each of said side sections being spaced and separated by a central grate section having a front edge aligned with a front edge of the side sections and a rear edge aligned with a rear edge of the side sections, said side sections each having an inner edge facing said central section, each of said inner edges including a central recessed portion, and said central grate section has a centrally located portion on each side which mates with and fits within the recessed portions of the side sections.

2. The cooktop of claim 1, wherein said central grate section includes a generally rectangular portion extending from the central generally circular portion to said central section front edge and a generally rectangular portion extending from the circular central portion to said central section rear edge.

3. The cooktop of claim 1, wherein said grate sections include a plurality of spaced fingers that extend inwardly above a burner to support a cooking utensil.

4. The cooktop of claim 1, wherein each of said burners has a center, and the center of said fifth burner is located approximately at the intersection of a diagonal line between the centers two opposite corners burners of the four burners and a diagonal line between the centers of the other two of the four burners.

5. The cooktop of claim 1 in combination with an oven positioned beneath the cooktop.

6. The cooktop of claim 1, wherein the width of the cooktop is about 30 inches.

* * * * *